US008991068B2

(12) United States Patent
Lakkineni et al.

(10) Patent No.: US 8,991,068 B2
(45) Date of Patent: Mar. 31, 2015

(54) ENERGY EFFICIENT CYCLE FOR CLOTHES DRYER

(75) Inventors: Venkat Ramprasad Lakkineni, Karnataka (IN); Martin Mitchell Zentner, Prospect, KY (US); Sanjay Manohar Anikhindi, Karnataka (IN); Steve Bernard Froelicher, Shepherdsville, KY (US); Nicholas Okruch, Jr., Mt. Washington, KY (US); Michael Thomas Beyerle, Pewee Valley, KY (US); Joshua Stephen Wiseman, Elizabethtown, KY (US); Nemetalla Salameh, Louisville, KY (US)

(73) Assignee: General Electric Company, Schenectady, NY (US)

( * ) Notice: Subject to any disclaimer, the term of this patent is extended or adjusted under 35 U.S.C. 154(b) by 883 days.

(21) Appl. No.: 13/162,109

(22) Filed: Jun. 16, 2011

(65) Prior Publication Data

US 2012/0317832 A1 Dec. 20, 2012

(51) Int. Cl.

| | |
|---|---|
| ***F26B 3/00*** | (2006.01) |
| ***D06F 58/28*** | (2006.01) |
| ***D06F 58/20*** | (2006.01) |
| *D06F 58/02* | (2006.01) |

(52) U.S. Cl.

CPC ..... *D06F 58/28* (2013.01); *D06F 58/20* (2013.01); *D06F 58/02* (2013.01); *D06F 2058/2829* (2013.01); *D06F 2058/2838* (2013.01); *D06F 2058/2864* (2013.01); *D06F 2058/289* (2013.01)

USPC ..... 34/477; 34/486; 34/491

(58) Field of Classification Search

USPC ..... 34/477, 486, 491

See application file for complete search history.

(56) References Cited

U.S. PATENT DOCUMENTS

| | | | | |
|---|---|---|---|---|
| 3,833,205 | A * | 9/1974 | McAnespie | 261/133 |
| 4,231,166 | A * | 11/1980 | McMillan | 34/553 |
| 4,397,101 | A | 8/1983 | Rickard | |
| 4,649,654 | A * | 3/1987 | Hikino et al. | 34/493 |
| 5,666,739 | A * | 9/1997 | Krueger | 34/86 |
| 5,899,005 | A | 5/1999 | Chen | |
| 6,122,840 | A | 9/2000 | Chbat et al. | |
| 7,426,791 | B2 | 9/2008 | Martin | |
| 7,478,486 | B2 | 1/2009 | Wunderlin et al. | |

* cited by examiner

*Primary Examiner* — Kenneth Rinehart
*Assistant Examiner* — Gajanan M Prabhu
(74) *Attorney, Agent, or Firm* — Fay Sharpe LLP

(57) ABSTRACT

Energy efficiencies are achieved in a dryer or washer/dryer by selectively varying temperature ranges, time periods, heater power levels, and air flow rates. Efficiency improvements on the order of 16% were obtained over typical constant power, constant temperature, timed drying cycles by varying one or more of these parameters. Efficiencies can also be improved by drawing air from alternative warm sources such as an attic or warm external environment, or by heat recovery from dryer exhaust passages.

23 Claims, 11 Drawing Sheets

250 252

| | CHARACTERISTIC | OBSERVATIONS | |
|---|---|---|---|
| | | WITH ~190 CFM FOR COMPLETE CYCLE | WITH ~90/ ~140/ ~190 CFM AT AIR INLET TEMP 290/260/220 F |
| INPUT DETAILS | BONE DRY WEIGHT (lb) | 8.9 | 8.9 |
| | SPIN DRY WEIGHT (lb) | 14.77 | 14.77 |
| | INITIAL MOISTURE CONTENT (IMC) | 65.4 PERCENT | 65.4 PERCENT |
| | DRYER SETTING | 50 MIN TIMED DRY / HIGH | 50 MIN TIMED DRY / HIGH |
| | HEATER ON TIME (min) | 45.0 | 45.0 |
| | COOLDOWN TIME (min) | 5.0 | 5.0 |
| | AVERAGE DRUM INLET AIR TEMP (F) (MAINTAINED WITH DIMMERSTAT) | ~240 | AT DIFFERENT TEMP: 290/260/220F |
| OUTPUT DETAILS | RMC @ END OF DRYING CYCLE | 0.95 PERCENT | 4.00 PERCENT |
| | ENERGY CONSUMED BY HEATER (KWhr) | 2.830 | 2.360 |
| | PERCENT ENERGY SAVINGS | 0.00 PERCENT | 16.61 PERCENT |

*Fig. 5*

ENERGY EFFICIENT CYCLE FOR CLOTHES DRYER

BACKGROUND OF THE DISCLOSURE

This disclosure relates to saving energy supplied to a clothes dryer, and more particularly relates to methods to improve clothes dryer energy usage while preferably using the same components or hardware found in typical commercially available clothes dryers and also to novel apparatus for enhancing dryer efficiency. It will be appreciated that the disclosure may also find application in a combination washer/dryer apparatus, or by selectively using one or various ones of the different features to be described below.

Appliances for drying articles such as clothes dryers are generally known in the art. Various ways of using heat energy for drying wet clothes in a clothes dryer are also known. For example, a user or consumer may set a predetermined drying time for drying the clothes. This requires the user to estimate the drying time and generally results in the clothing articles being over-heated or under-heated. Selection of an unnecessarily long drying time results in over-heating the clothing articles, higher energy consumption, and the potential for damaging the clothes. Selection of too short a drying time results in the user needing to select a new drying time and subsequently monitor the dryness of the clothes through one or more additional drying periods.

Other models of clothes dryers employ sensors and associated controllers that receive sensor signals and predict a moisture content and degree of dryness in the articles. For example, a temperature sensor or humidity sensor provides appropriate signals to the controller and in response to the input data, the controller predicts a percentage of moisture content and a degree of dryness of the clothing articles. Commonly-owned U.S. Pat. No. 5,899,005 is generally representative of such a clothes dryer and associated process.

Another clothes dryer and associated method stores historical data in a memory. An initial drying time estimate is calculated, and the final time estimate re-calculated based on input time and moisture parameters from one or more sensors, which are then periodically compared to the estimates stored in the memory until such time as the drying cycle is terminated. For example, U.S. Pat. No. 7,478,486 is also commonly-owned by the assignee of the present application and representative of such an arrangement.

There is an ever-increasing desire to save energy in association with operating appliances and particularly for a clothes dryer. The clothes dryers at present are able to give complete drying performance with the help of various sensors and controls as noted above. However, by design both airflow rate and drum inlet air temperature are maintained constant. As a result, the supply of energy can be either more or less than actually required depending on different stages of the clothes drying process. Energy savings in known units is typically achieved by regulating the supply to the heater or by not allowing the clothes to over-heat with the assistance of controls and sensors. However, the goal of known arrangements is slightly different, i.e., to achieve complete drying without any clothing over-heat. These arrangements, however, are not believed to sufficiently save energy and there is a perceived need for improvement.

Thus, a need exists for obtaining similar drying performance with less energy consumption, and preferably using many of the same components or hardware to achieve these goals.

SUMMARY OF THE DISCLOSURE

An exemplary method of drying wet clothes includes dividing a drying cycle into at least three drying periods, including a preheating stage, a latent heat transfer stage, and a sensible heat transfer stage. The method further varies air residence time in at least one of the stages relative to another stage by varying the drying air flow rate and drum inlet air temperatures.

The varying step includes providing a low or first airflow rate in the preheating stage at an elevated air inlet temperature, providing an increased or second airflow in the latent heat transfer stage that is greater than the first airflow rate, and at a lower air inlet temperature, and increasing the airflow rate to a greatest or third airflow rate, and at a lowest air inlet temperature.

Alternatively, airflow rate may be higher in the sensible or third heat transfer stage than in the latent heat transfer stage.

A low airflow may also be provided just prior to termination of the drying cycle.

In one exemplary embodiment, the air inlet temperature is approximately 290° F. at an airflow rate of approximately 90 CFM (cubic feet per minute) in the preheating stage, the temperature is reduced to approximately 260° F. at an airflow rate of approximately 140 CFM in the latent heat transfer stage, and the air inlet temperature reduced to approximately 220° F. at about 190 CFM in the sensible heat transfer stage.

The process may include introducing air from an external warm air source, such as an attic or warm outside ambient air.

An exhaust air recovery assembly includes an exhaust passage that receives air from a drum of the associated dryer and directs the air to an associated outside vent. A recirculation passage receives air from the associated dryer housing, circulates the air about the exhaust passage, and directs the air toward a heater intake of the associated dryer.

A controller may be further included for varying amounts of the air re-circulated in the associated dryer housing.

A primary advantage of the present disclosure is reducing energy consumption.

Another advantage is saving energy supplied to a clothes dryer by changing the air residence time and inlet air temperatures in the dryer drum at different stages of the clothes drying process.

Still other benefits and advantages may be achieved in accordance with the following detailed description.

BRIEF DESCRIPTION OF THE DRAWINGS

FIG. 5 is a table of various characteristics illustrating an energy savings of approximately 16.61%.

DETAILED DESCRIPTION OF THE PREFERRED EMBODIMENTS

Figure 1:
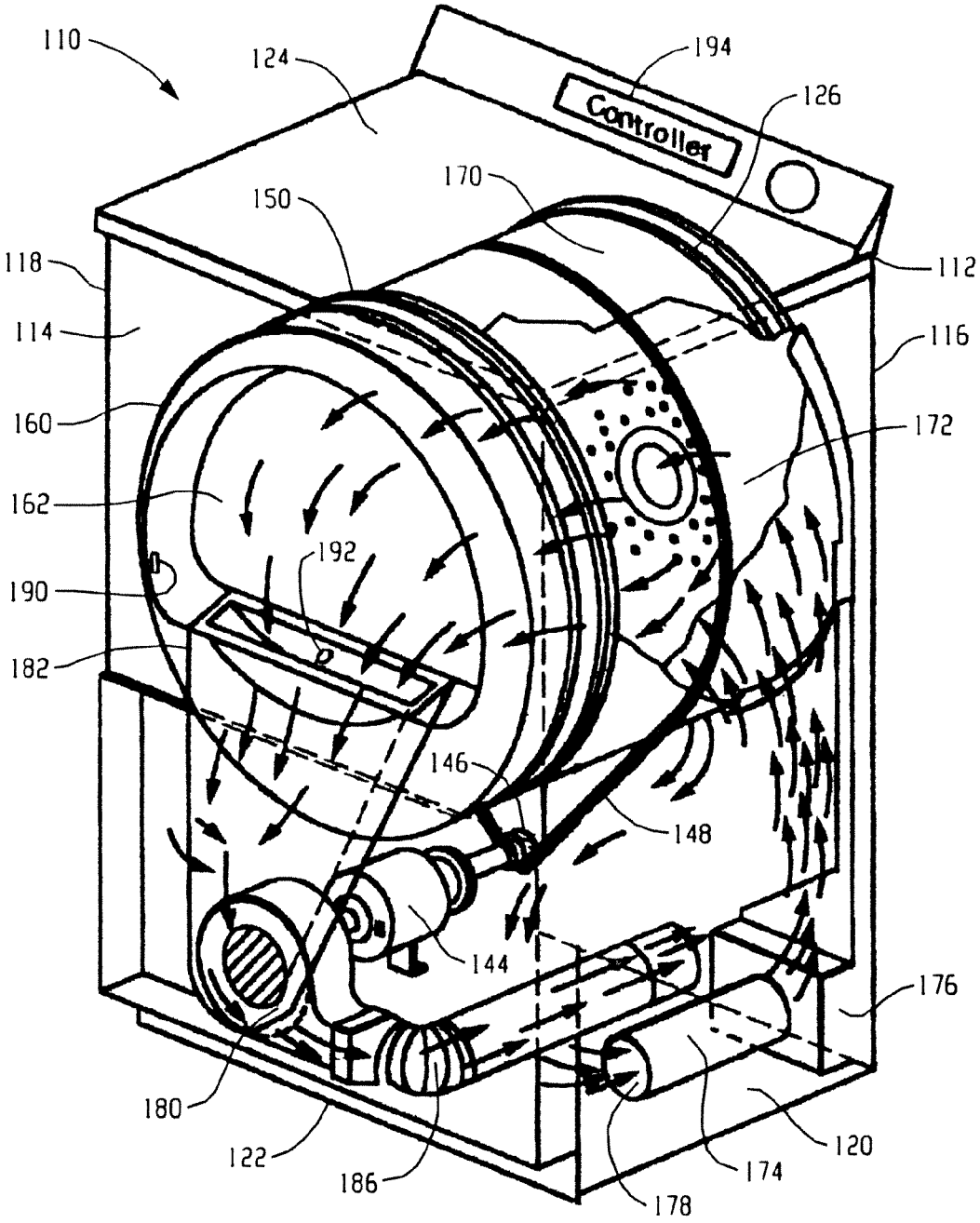
FIG. 1 is a perspective view of a clothes dryer as used in the present disclosure.

Turning first to FIG. 1, a clothes dryer 110 includes a cabinet or main housing 112 having a first or front panel 114, a second or rear panel 116, and a pair of third and fourth, or side, panels 118, 120 disposed in spaced relation from each other by the front and rear panels, a fifth or bottom panel 122, and a sixth or top cover 124. Within the housing 112 is a drum or container 126 mounted for rotation around an axis, shown here as a substantially horizontal axis HA. Motor 144 rotates the drum about the horizontal axis through a drive means such as pulley 146 and belt 148. The drum is preferably generally cylindrical in shape, and typically has an imperforate outer cylindrical wall 150 and a front flange or wall 160 that has an opening 162 to the drum. Clothing articles or other fabrics are loaded into the drum 126 through the opening 162. A plurality of tumbling ribs (not shown) are usually provided within the drum 126 to lift the articles and allow the articles to tumble back toward the bottom of the drum as the drum rotates. The drum includes a rear wall 170 rotatably supported within the main housing 112 by a suitable fixed bearing. The rear wall 170 includes a plurality of openings or holes 172 that receive hot air that has been heated by a heater, such as a combustion chamber 174 and a rear duct 176. The combustion chamber 174 receives ambient air via an inlet 178. Although the clothes dryer shown in FIG. 1 is a gas dryer, it could just well be an electric dryer without the combustion chamber 174 and the rear duct 176. Instead in an electric clothes dryer, the air is heated by an electric heating element or heater. Heated air is drawn from the drum by a blower fan 180 which is also advantageously driven by the motor 144. The air passes through a screen filter 182 which traps lint particles in a manner known in the art. As the air passes through the screen filter 182, it enters a trap duct seal 184 and is passed out of the clothes dryer through an exhaust duct 186. After the clothing articles have been dried, they are removed from the drum via the opening 162.

A temperature sensor 190 and a wetness sensor 192 are often used to predict moisture content and degree of dryness of the clothing articles in the container. The temperature sensor 190 senses the temperature of the heated air passing through the screen filter, for example, while the wetness sensor 192 senses the wetness of the clothes in the drum, for example. The temperature sensor may be a commercially available sensor such as an Omega Thermocouple-type K, and the wetness sensor may be a commercial off-the-shelf item such as a Parametrics HT-119, although such commercially available components are representative only and one skilled in the art will appreciate that other components that serve these purposes could be used without departing from the scope and intent of the present disclosure. The temperature and wetness sensors provide signal representations of the temperature of the heated air, and the wetness of the clothes in the drum, respectively, to a controller 194. The controller 194 is responsive to the temperature sensor and the wetness sensor and, as described below, the controller may then alter operation of the dryer in various ways to save energy over known arrangements (including varying the temperature or flow rate of the air into the drum, varying amounts of re-circulated air, etc.).

It will also be appreciated that although the following results are taken from an electric dryer, i.e., an electric heating element, the concept would also be equally applicable to a gas dryer, or combination gas/electric dryer without departing from the principles of the present disclosure. The clothes dryers, at present are able to give complete drying performance, with the help of various sensors/controls. However, in the present process, both air flow rate and drum inlet air temperature are maintained constant, by design. Due to this phenomenon, the supply of energy could be either more or less than actually required, depending on different stages of the clothes drying process and hence giving a scope for optimizing energy consumption. This disclosure of varying the air flow rate and drum inlet air temperature, at different stages of the clothes drying process, will give the similar drying performance, with less energy consumption.

An electric clothes dryer uses hot air, heated by heater and circulated by a blower, for drying clothes. Water in the wet clothes is removed due to a gradient in partial pressures of water vapor between the hot air entering the dryer drum and the air layer adjacent to wet clothes. The higher the wet cloth temperature, the higher the partial pressure gradient and the higher the partial pressure gradient, the more water removal rate from the clothes. Also, there will be two modes of heat transfer between the hot air and the wet clothes; one is the sensible heat transfer from hot air to wet clothes and the other is latent heat of vaporization that is taken from wet clothes. Based on the net effect of these two modes of heat transfer, the clothes temperature will either increase or remain unchanged.

Figure 3:
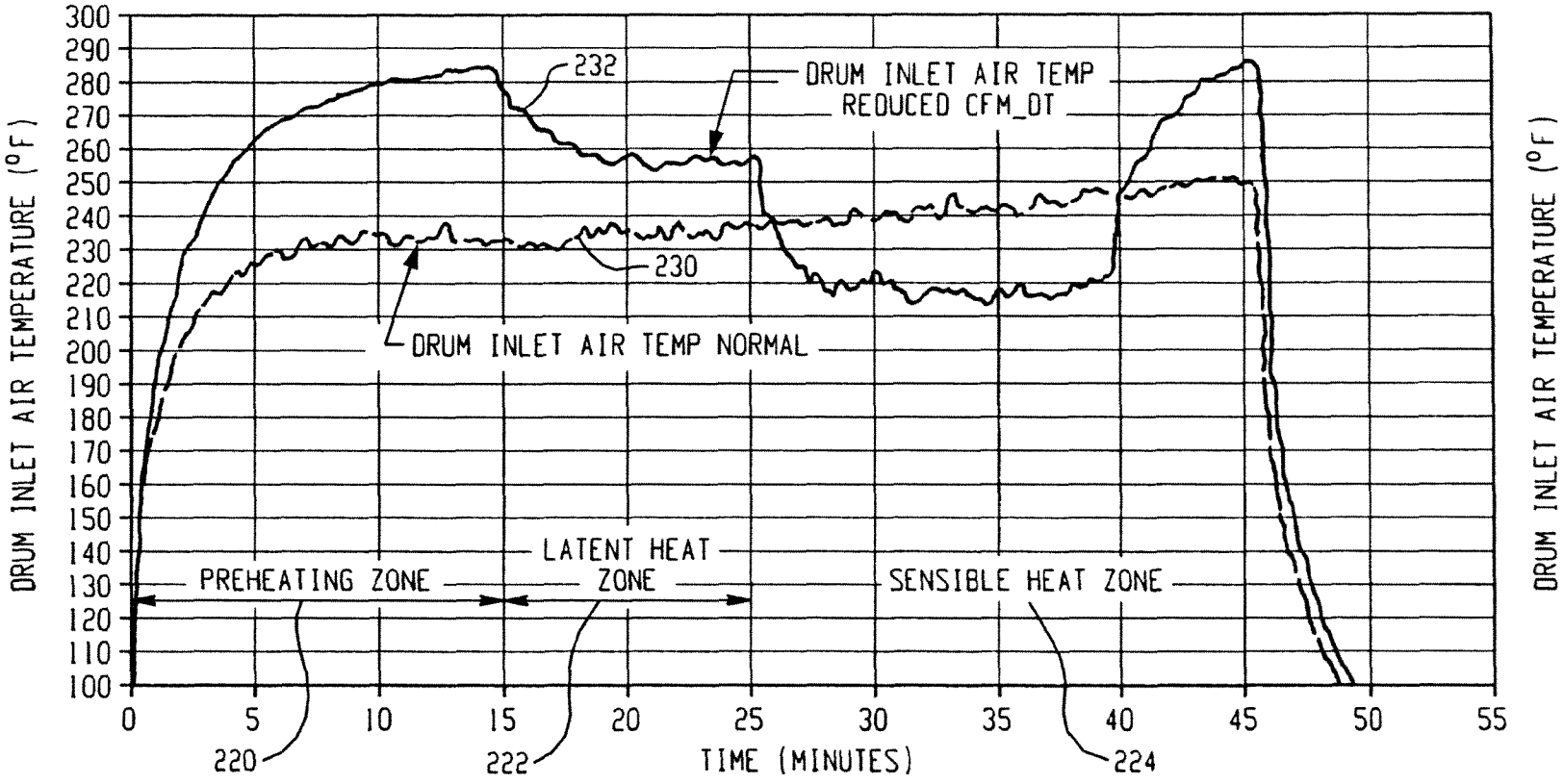
FIG. 3 is a graphical comparison of drum inlet air temperatures for normal and proposed cycles.
Figure 4:
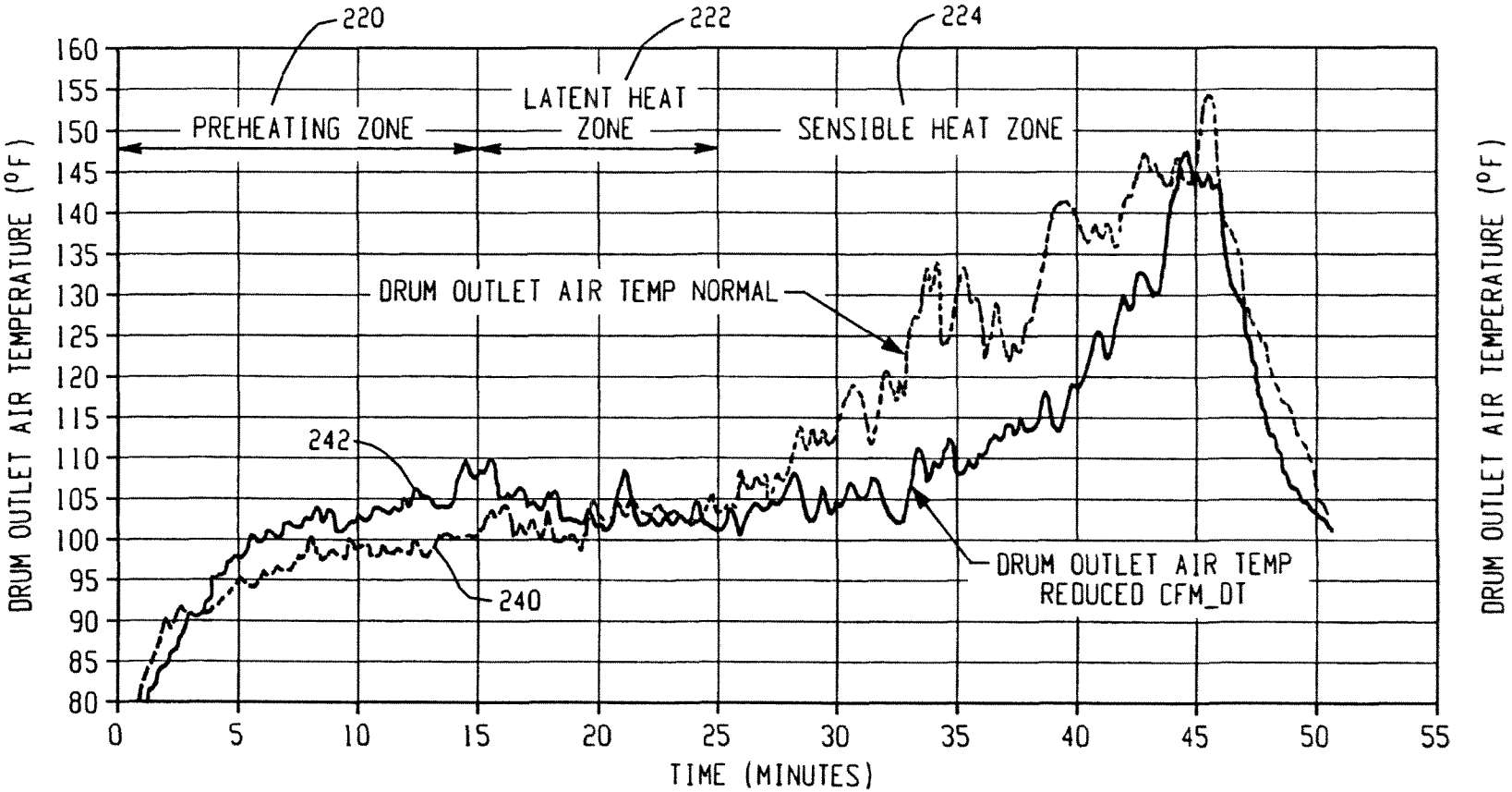
FIG. 4 is a graphical comparison of drum outlet air temperatures for normal and proposed cycles.

A typical clothes drying process can be divided into three zones, namely a preheating zone, a latent heat transfer zone and a sensible heat transfer zone (see FIGS. 3 and 4). During the preheating zone, wet clothes take the heat from the hot air and the temperature of the clothes increases, as the sensible heat transferred from hot air will be more than the latent heat of vaporization. The temperature of wet clothes will increase to reach a plateau (see FIG. 4) and the latent heat transfer zone starts. During this zone, the sensible heat transferred from hot air and the latent heat of vaporization will be very close and hence, the wet clothes temperature will remain more or less constant. Once the water in the wet clothes reduces below certain levels, again the sensible heat transferred from hot air will be more than the latent heat of vaporization and hence the temperature of clothes start increasing, until the hot air supply is stopped.

This disclosure is about supplying air for different zones (see FIGS. 3 and 4), for example:

1) Preheating zone: higher inlet air temperature (290° F.) at lower air flow rate (90 CFM), so that the clothes temperature can increase faster;

2) Latent Heat Transfer zone: slightly lower inlet air temperature (260° F.) and higher airflow rates (140 CFM) than the preheating zone, so that more heat can be transferred without any increase in clothes temperature and hence no damage to the clothes; and 3) Sensible heat Zone: the lowest inlet air temperature (220° F.), at the highest air flow rates (190 CFM), to ensure that moisture is driven out and the clothes temperature will not increase unnecessarily.

Figure 2:
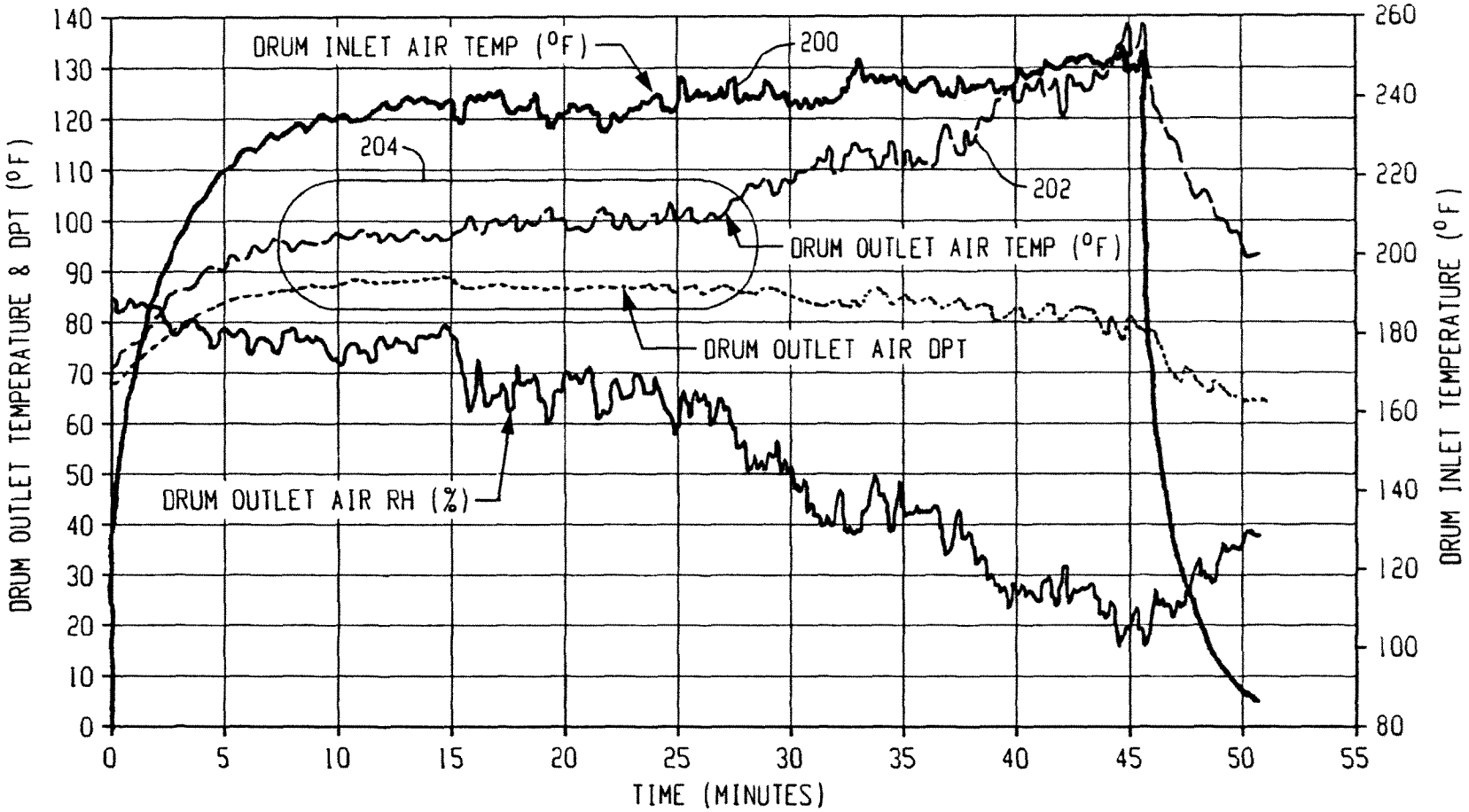
FIG. 2 is a graph of a typical drying cycle.

For a given drum volume and cloth load, the air residence time is a function of the airflow rate into the drum. Generally speaking, by varying the airflow rate and the inlet air temperature during different stages of the drying cycle, an energy savings of up to sixteen percent (16%) can be achieved for similar drying performance. As shown in FIG. 2, drum inlet and outlet temperatures (in degrees Fahrenheit) are graphed relative to time (in minutes) where the temperature and relative humidity are monitored in a typical drying cycle. In such a drying cycle, drum inlet air temperature does not change significantly once it reaches a peak of approximately two hundred forty degrees (240°) F. as represented by plot 200. As will be appreciated, this occurs at approximately fifteen minutes after beginning the drying cycle, and continues through until the heat source is de-energized as shown in FIG. 2, at approximately forty-five minutes, at which time the inlet temperature drops dramatically between forty-five and fifty minutes. The drum outlet air temperature 202 increases to approximately one hundred degrees (100°) F. and remains unchanged for a significant period of time, e.g., between about five minutes to about twenty-five minutes into the cycle, and then begins to steadily increase to approximately one hundred thirty degrees (130°) F. about forty-five minutes into the cycle. At the end of the dryer cycle, i.e., between approximately forty-five and fifty minutes as shown in the example of FIG. 2, the drum outlet air temperature then decreases. In FIG. 2, the dry cycle is a time controlled dry cycle and thereby automatically terminated at the end of the time period, although it will be appreciated that the dry cycle could be based on the sensed outlet temperature increasing to the level of the inlet air temperature and then terminated.

The rate of heat transfer between hot air and wet clothes can be improved in one of two ways, by increasing the temperature of the entering air, or by increasing the air residence time. Increasing the temperature of entering air has the limitation that clothes are potentially damaged if the temperature reaches an overheat condition. Increasing the air residence time has the potential to improve the rate of heat transfer while avoiding this limitation. For a given drum volume and load of clothes, air residence time can be increased by reducing airflow rate into the drum. Hot air entering the drum of the dryer transfers heat to the wet clothes and carries the water vapor along with it. During an initial part of the drying cycle, water in the wet clothes absorbs more heat from the hot air without much increase in the temperature of the clothes. Increasing the air residence time during this part of the drying cycle results in an increase in the rate of heat transfer between the hot air and the water in the wet clothes. Hence, energy supplied to heat the air is reduced as the airflow rate is reduced.

Referring now to FIGS. 3 & 4, a clothes drying cycle can be divided into three relatively distinct divisions or zones, namely a preheating zone 220, a latent heat zone 222, and a sensible heat zone 224. During the preheating zone, initially heat from the heated inlet air is used to heat the damp clothes and the drum that contains them. As the clothes become warmer less heat is absorbed and the sensed temperature of the inlet air increases until the air temperature reaches approximately the temperature of the latent heat of vaporization for the moisture remaining in the clothes, at which level the sensed inlet air temperature reaches a temporary plateau. During this plateau period, referred to as the latent heat zone, moisture continues to be removed from the clothes until a point is reached where the heat available from the inlet air exceeds that absorbed as latent heat of vaporization and the sensed air temperature begins to gradually increase. This occurrence marks the transition from the latent heat zone to the sensible heat zone. In the typical dry cycle illustrated by plot 230, the preheat zone comprises approximately the first fifteen minutes of the dry cycle, the latent heat zone comprises approximately the next 10 minutes of the dry cycle and the sensible heat zone comprises the balance of the dry cycle. Given this characteristic nature of the dry cycle further modifications relative to the typical dry cycle can be made that reduce the energy consumption. For example, rather than maintaining a constant airflow rate and drum inlet air temperature as employed in a typical drying cycle, to achieve energy savings, varying airflow rates and air entry temperatures over various portions of the entire drying cycle results in energy savings. As shown in the graph of FIG. 4, plot 230 is representative of a typical or normal drum inlet air temperature that is brought up to approximately two hundred forty degrees (240°) F. in the preheating zone 220 and remains at around two hundred forty degrees (240°) F. through the latent heat zone 222 and sensible heat zone 224 before decreasing at the end of the cycle. Plot 232 represents a drying cycle in which the airflow and drum inlet air temperatures are altered throughout the three distinct zones to result in further energy savings. In this exemplary embodiment the drum inlet air is heated to an elevated temperature of approximately two hundred ninety degrees (290°) F. during a first or preheat portion of the dry cycle (the preheat zone 220) and a first airflow rate of approximately ninety (90) CFM is implemented which is less half the typical rate of 190 CFM while in this preheat zone 220. In this exemplary embodiment, the preheat zone comprises approximately the first fifteen minutes of the drying cycle. Through testing, it was determined that the dryer chassis, drum and other metal components need to be heated before modulating the airflow could be beneficial and this was determined to occur at about fifteen minutes in testing, although it is recognized that under other conditions, a different time period may be used.

In the latent heat zone 222, which comprises approximately the next ten minutes of the drying cycle, the drum inlet air temperature is reduced to a second predetermined temperature level of approximately two hundred sixty degrees (260°) F. in this embodiment, while the airflow rate is increased to a second predetermined rate of approximately one hundred forty (140) CFM. The controlled reduction in sensed inlet air temperature is time based for this example but could be incorporated in the dryer control software as a look-up table depending on cycle selection, load size and initial moisture content. The ten minute period is again selected through experimental data for this example (with recognition that this time period may be different under different conditions). The time intervals would be different for different loads and initial moisture contents. Maximizing the humidity in the exit air is the goal. As the temperatures in the clothes load increases, the capacity of carrying moisture also increases. The rationale is that the airflow is reduced hence increasing the temperature and increasing moisture content of the exit air. Removing the air more rapidly at the point of high moisture content helps keep the total dry time down due to not tripping the thermostats too early.

In the sensible heat zone 224 of FIG. 3, the drum inlet air temperature is further reduced to a third pre-determined temperature (approximately two hundred twenty five degrees) (225° F. in this embodiment) and the air flow rate is still further increased to a third pre-determined rate (approximately one hundred ninety (190) CFM in the exemplary embodiment). This lower air temperature, at a higher airflow rate, insures that moisture is driven out and that the clothing temperature will not increase unnecessarily.

The drum outlet air temperature is illustrated in FIG. 4. In a typical drying process, the drum outlet air temperature begins to increase approximately twenty-five minutes into the cycle. It is determined that this may cause unnecessary wasting of heat energy. This is represented by the plot 240 in FIG. 4. As a result of the control implemented in the embodiment of FIGS. 3 and 4, the drum outlet air temperature begins to increase after approximately the thirty-fifth minute. This, of course, evidences a savings of heat energy. The plot illustrated at 242 in FIG. 4 suggests that the air temperature reaches one hundred degrees) (100° F. faster in the preheating zone with less energy supply when compared to the typical operating cycle. The plots 240 and 242 of FIG. 4 represent outlet temperatures that result from operating the dryer in a manner, which produces the inlet temperature plots 230 and 232 of FIG. 3.

The tabulated test results are shown in FIG. 5 which compares results 250 of a normal or typical drying cycle, where the airflow rate and power input to heater are constant over the entire cycle, with results 252 of proposed variations of air inlet temperature and airflow rate as described above in connection with FIGS. 3 and 4. A substantially comparable relative moisture content is achieved at the end of a timed drying cycle (total of fifty minutes in the exemplary tests), with a significant energy reduction measured on an electric heater of approximately 0.5 kilowatt hours or an estimated energy savings of approximately 16.61% by implementing the variations in air inlet temperature and airflow rate. Thus, energy savings by varying both the airflow rate and the drum inlet air temperature as shown in the tabulated results is achieved without any additional hardware required for the clothes dryer and by simply modifying the algorithm used by the microcontroller to control drum inlet air temperature and airflow rate. It will also be appreciated that this energy savings feature can be used in a stand-alone clothes dryer or also implemented in a washer-dryer combination machine. With no real increase in drying time, the consumer can be provided the option of a significant energy savings by implementing these features. Feedback from the sensors as fed to the microcontroller allows for required changes in operation of the blower and heater coil to alter the airflow rate and drum inlet air temperature, respectively.

Figure 6:
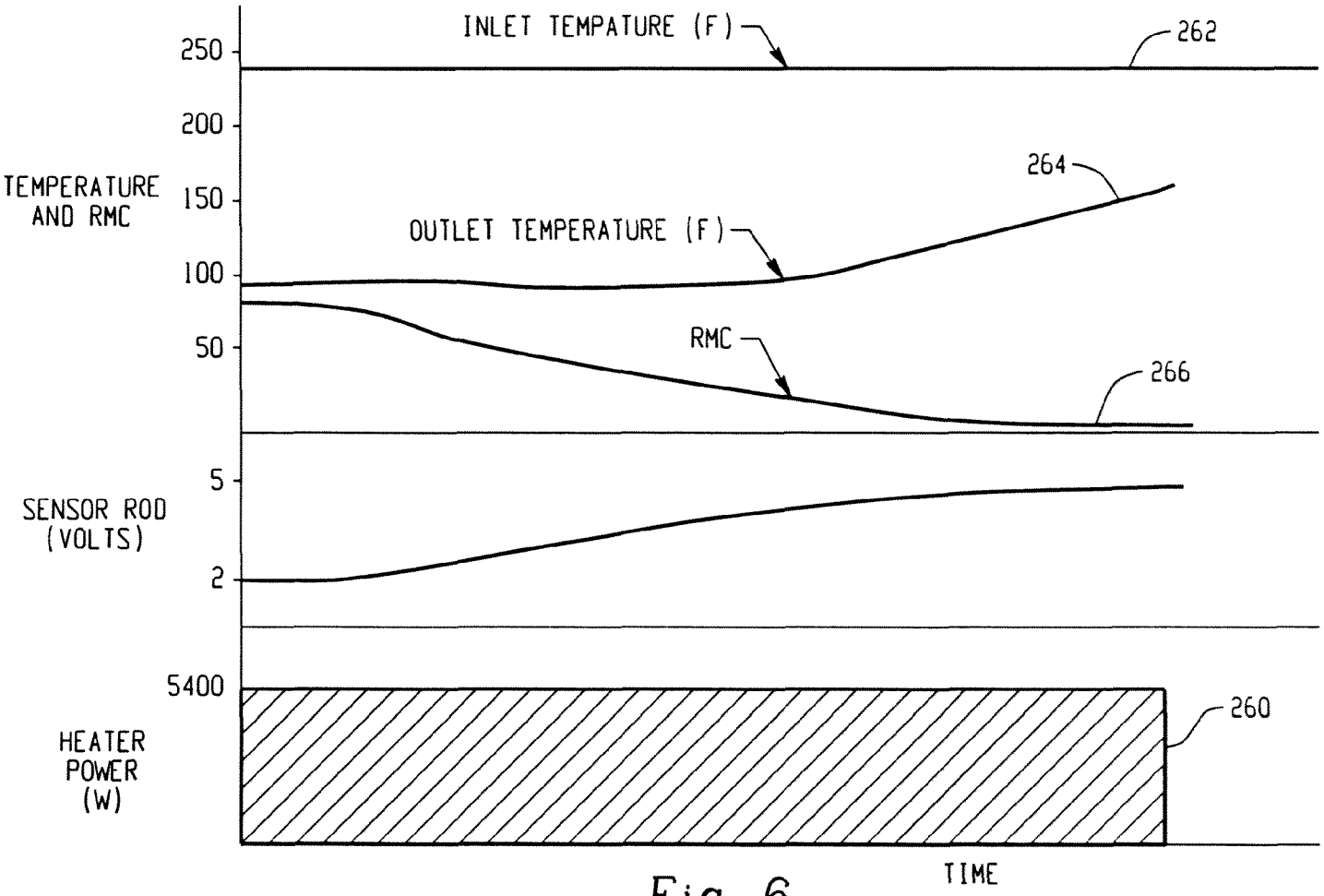
Fig. 6 PRIOR ART
FIG. 6 is a graphical representation of typical normal operation of a dryer using 5400 watts of heater power.

FIGS. 6-9 are graphical representations of still other methods to improve the energy usage associated with clothes dryers. As represented in FIG. 6, a typical drying operation, which serves as a base-line for comparison purposes, may employ an electrical heater that is supplied with a constant heater power of five thousand four hundred (5400) watts (plot 260). This correlates to a dryer inlet air temperature of approximately two hundred forty degrees) (240° F. as represented by plot 262. The drum outlet temperature, represented by plot 264, is generally constant over much of the dryer operation and then increases from about ninety degrees (90°) F. to approximately one hundred fifty degrees (150°) F. toward the end of the timed cycle. The relative moisture content is shown to decrease over the drying cycle as evidenced by plot 266.

Figure 7:
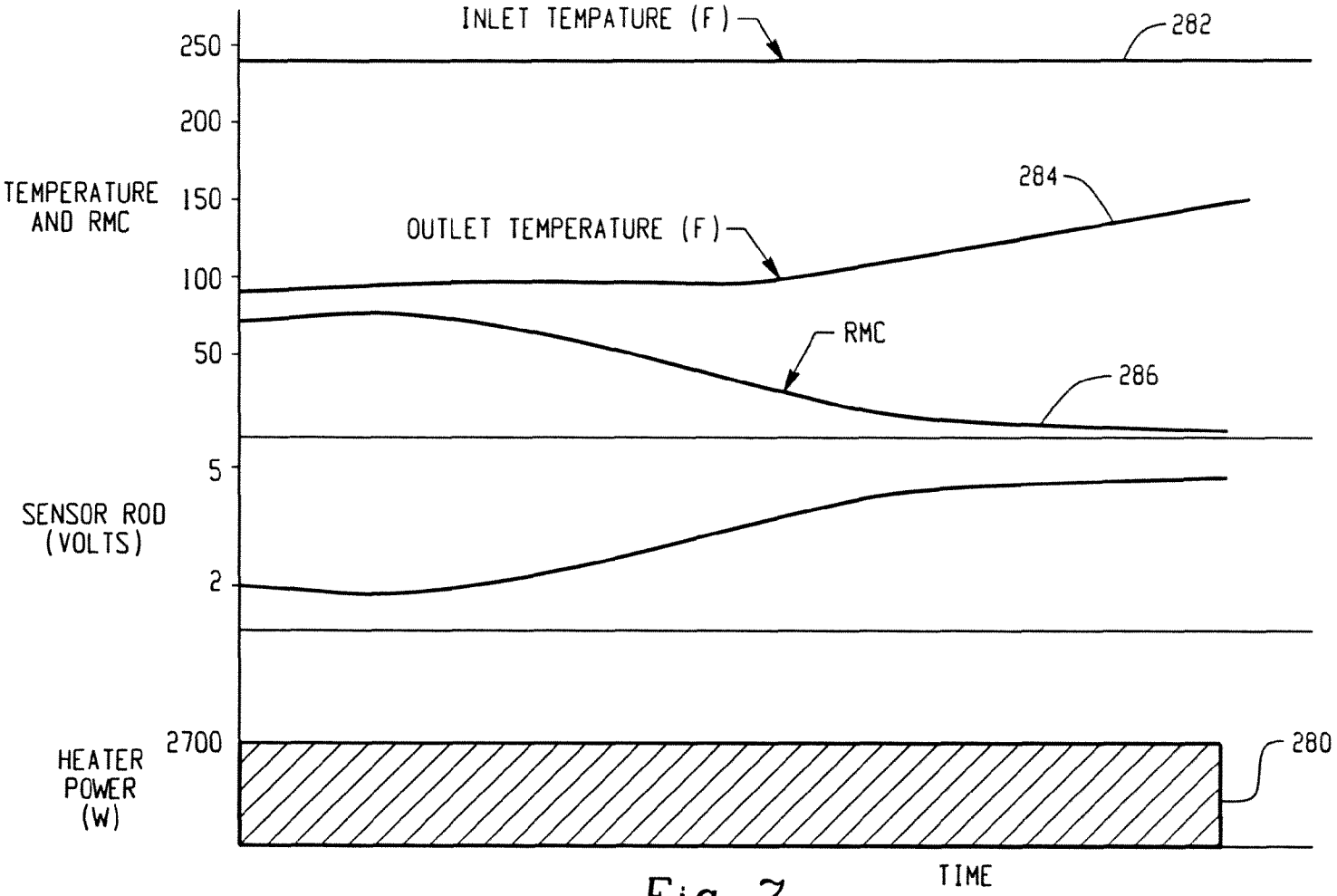
FIG. 7 is a graphical representation similar to FIG. 6 using a heater power of only 2700 watts.

In one arrangement, the heater power is cut in half, i.e., to approximately two thousand seven hundred (2700) watts as evidenced by graph 280 in FIG. 7. The inlet drum air temperature is still maintained at approximately two hundred forty degrees (240°) F. (plot 282), the drum outlet air temperature remains substantially the same (plot 284), and the relative moisture content varies slightly over the same time period as represented by plot 286. Thus, although the relative moisture content curve is slightly different in FIG. 7 than in FIG. 6, it ultimately reaches approximately the same final level over the same time period and yet the dryer only uses half the heater power at two thousand seven hundred (2700) watts.

Figure 8:
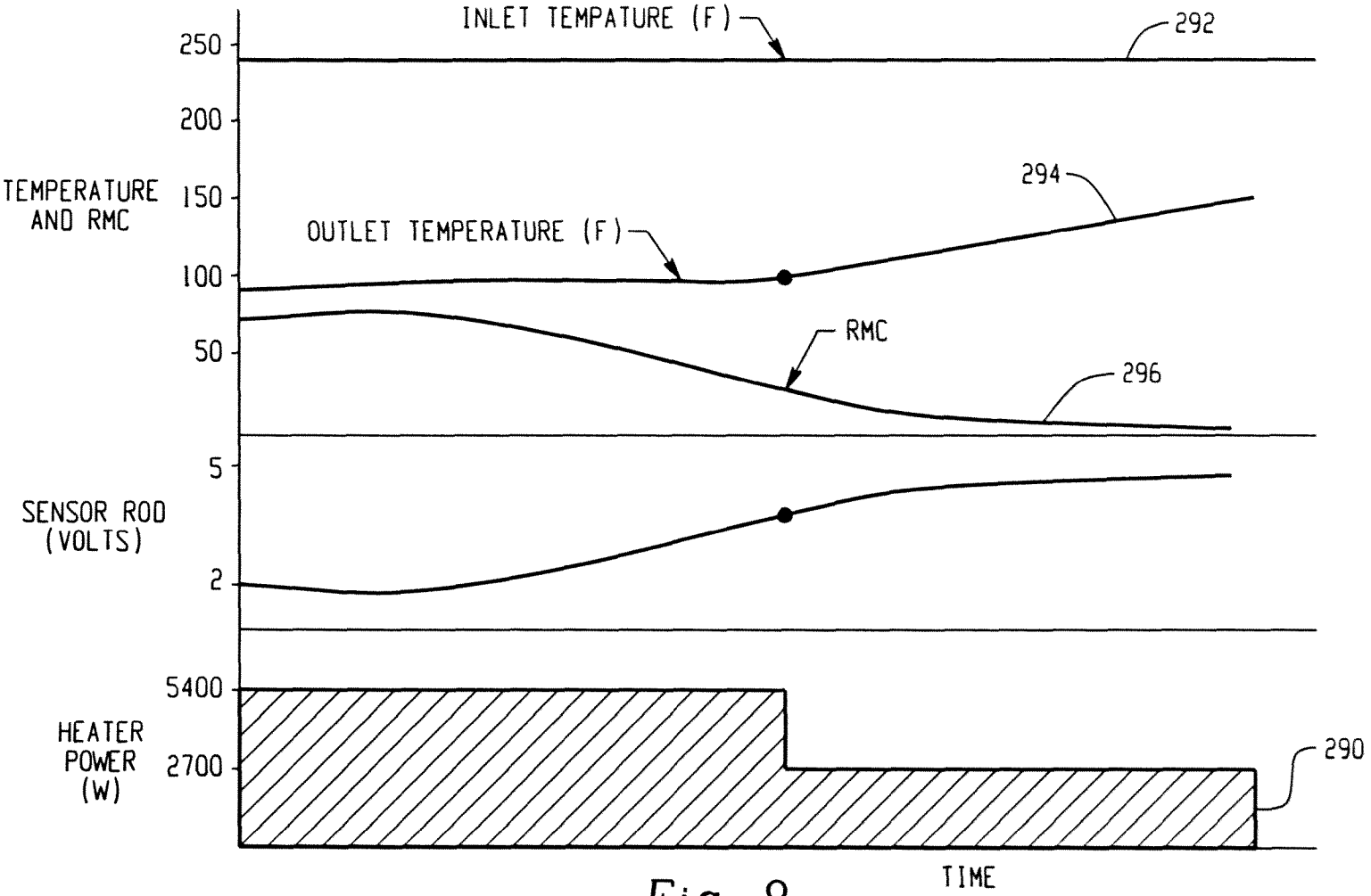
FIG. 8 is a graphical representation of an alternative drying cycle in which the heater power is curtailed from 5400 watts to 2700 watts part way through the cycle.

A variation on the theme is shown in FIG. 8, where heater power is supplied at the higher wattage level, five thousand four hundred (5400) watts for a predetermined period of the time (about one-half the time period) and then changed to the reduced heater power level of two thousand seven hundred (2700) watts over approximately the last one-half portion of the dryer cycle (plot 290). Once again, the drum inlet air temperature is at approximately two hundred forty degrees (240°) F., as evidenced by plot 292 in FIG. 8, and the outlet air temperature from the drum ranges from approximately ninety degrees (90°) F. to an end value of approximately one hundred forty (140°) F. as represented by plot 294. The relative moisture content also decreases over time, i.e., the clothes dry in response to the heated air and airflow, and the curve is more akin to the relative moisture content curve 286 of FIG. 7, ultimately reaching what would be deemed a "dry clothes" at the end of the cycle (plot 296).

Figure 9:
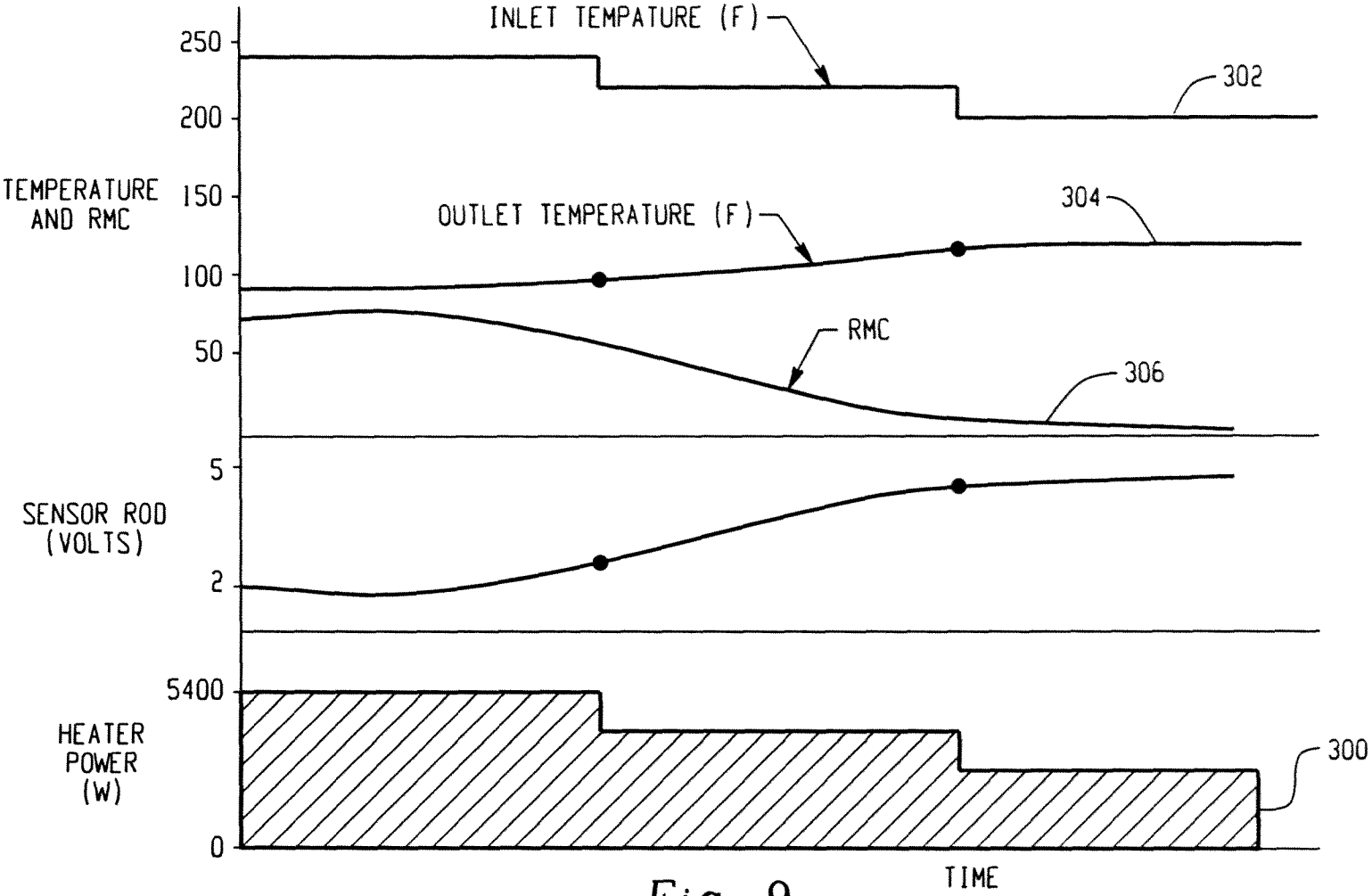
FIG. 9 is graphical representation of yet another alternative where heater power is stepped down in increments from 5400 watts to 2700 watts.

Still another arrangement is to reduce the inlet air drum temperature by periodically stepping-down the input power as represented in plot line 300 in FIG. 9. The initial wattage is approximately five thousand four hundred (5400) watts, and then reduced by approximately one-quarter about one-third of the way through the cycle, and reduced another one-quarter to the two thousand seven hundred (2700) watt level two-thirds of the way through the cycle. As is evident, the corresponding drum inlet air temperature plot 302 tracks the periodic reduction in the heater power, beginning at a temperature of approximately two hundred forty degrees (240°) F., and reducing to a level around two hundred twenty five degrees (225°) F. approximately one-third of the way through the cycle, and further reducing to about two hundred degrees (200°) F. for approximately the last third of the drying cycle. The inlet air temperatures in FIGS. 6-8 stay constant with varying heater wattage due to non-fluctuating or constant inlet air thermistor set points (plot 262 in FIG. 6, plot 282 in FIG. 7 and plot 292 in FIG. 8). In FIG. 9, however, the inlet air thermistor set points fluctuate (see plot 302 in FIG. 9). The outlet air temperature from the drum shown in plot 304, on the other hand, slowly increases from about ninety degrees (90°) F. to approximately one hundred twenty degrees (120°) F. over this same time period, while the relative moisture content (plot 306) drops from the original level to a "dry" level by the termination of the drying cycle. Once again, the reduction in heater power, even if the airflow is maintained the same, will result in a significant energy savings, and may be reduced even more depending on how airflow is altered under such an arrangement.

Each of FIGS. 7-9 demonstrate that reducing the amount of electrical heater power results in energy savings over what is deemed a typical drying cycle as exhibited in FIG. 6 of a constant heater power over the entire dryer cycle time period. By monitoring the outlet dryer temperature and/or the dampness of the load, i.e., by sensor rods contacting the clothes, the heater power can be reduced as the outlet temperature increases. This will, in turn, cause less wasted heat and save energy over the drying cycle. Monitoring either the outlet dryer temperature or the dampness of the load via the sensor rods also permits the inlet thermistor to be set in response thereto to reduce the heater power, or the fan speed, or both. Again, this will cause less wasted heat over the cycle and result in an energy savings. The controller monitors outlet and inlet air temperatures and, in response, reacts with different wattage outputs.

Figure 10:
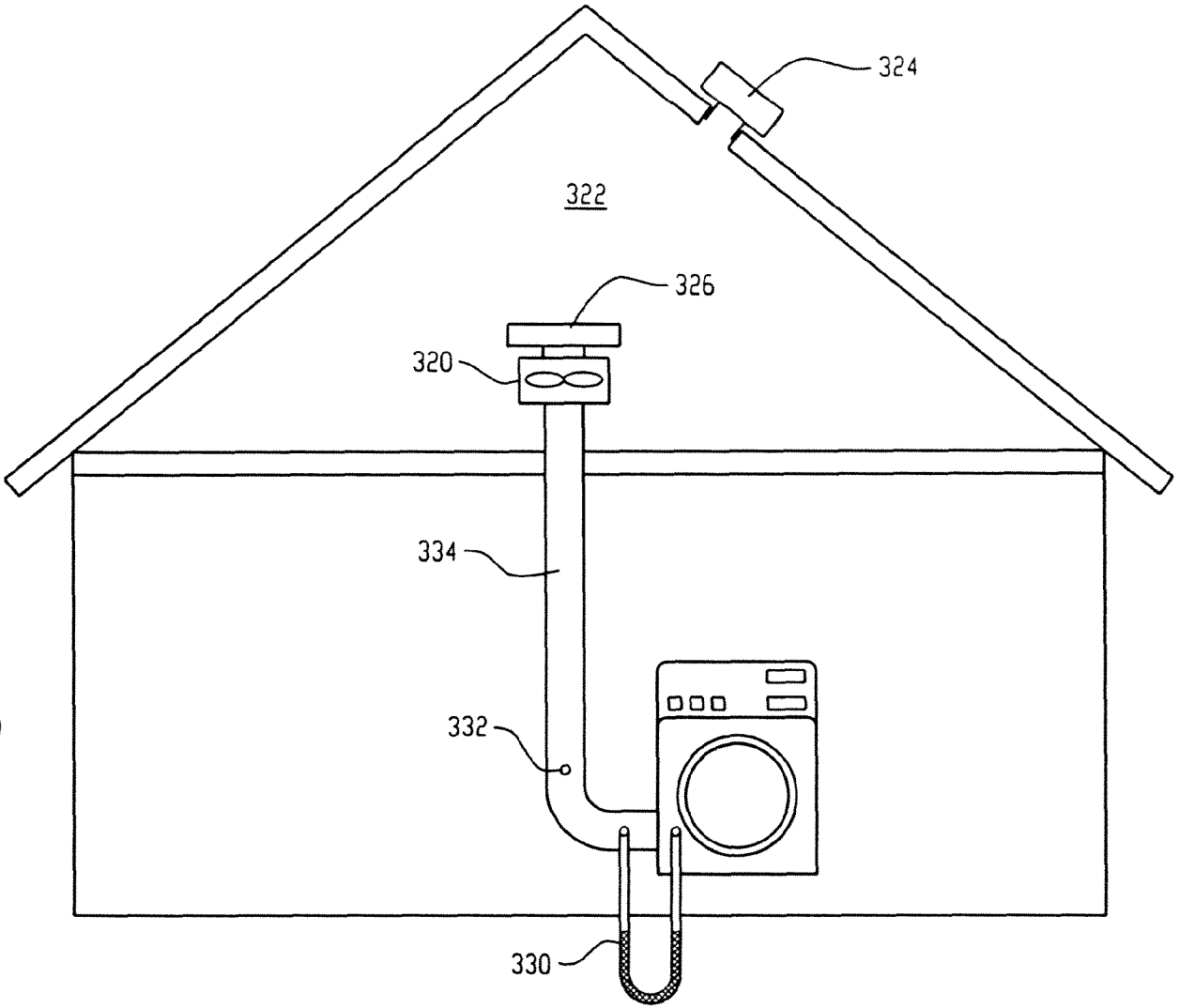
FIG. 10 is a schematic representation of alternative sources of warm air to reduce energy costs.

FIG. 10 represents another potential energy savings feature. Particularly, a fan 320 is located in the attic 322 that includes an attic vent 324, or possibly outside the building or home. Warm air is drawn through air filter 326 disposed in the attic into the dryer housing from an outside source such as the attic or outside air. This eliminates the need to pull warm air from inside the house to the dryer. Air from the dryer is then directed outside the house. This arrangement will also reduce the energy needed to heat the air from ambient temperature. Such an energy savings kit would include, for example, a variable speed fan, pressure switches 330, temperature sensors 332, and associated duct work 334. The remotely located fan will be controlled by the pressure switch and the dryer controller uses the remote temperature sensor as an input to determine whether air should be blown into the cabinet from the remote outside source. It will also be appreciated that taking heat out of the attic will result in an energy savings for the house, not just an improvement in savings associated with reduced dryer energy. For example, in the summer months, the air conditioner load could be reduced with a lower attic temperature.

Figure 11:
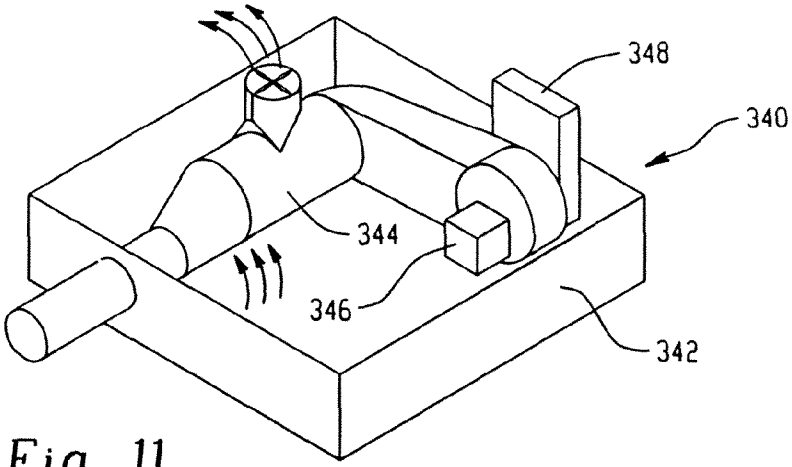
FIG. 11 is a perspective view of an exhaust air heat recovery assembly for use with a dryer.
Figure 12:
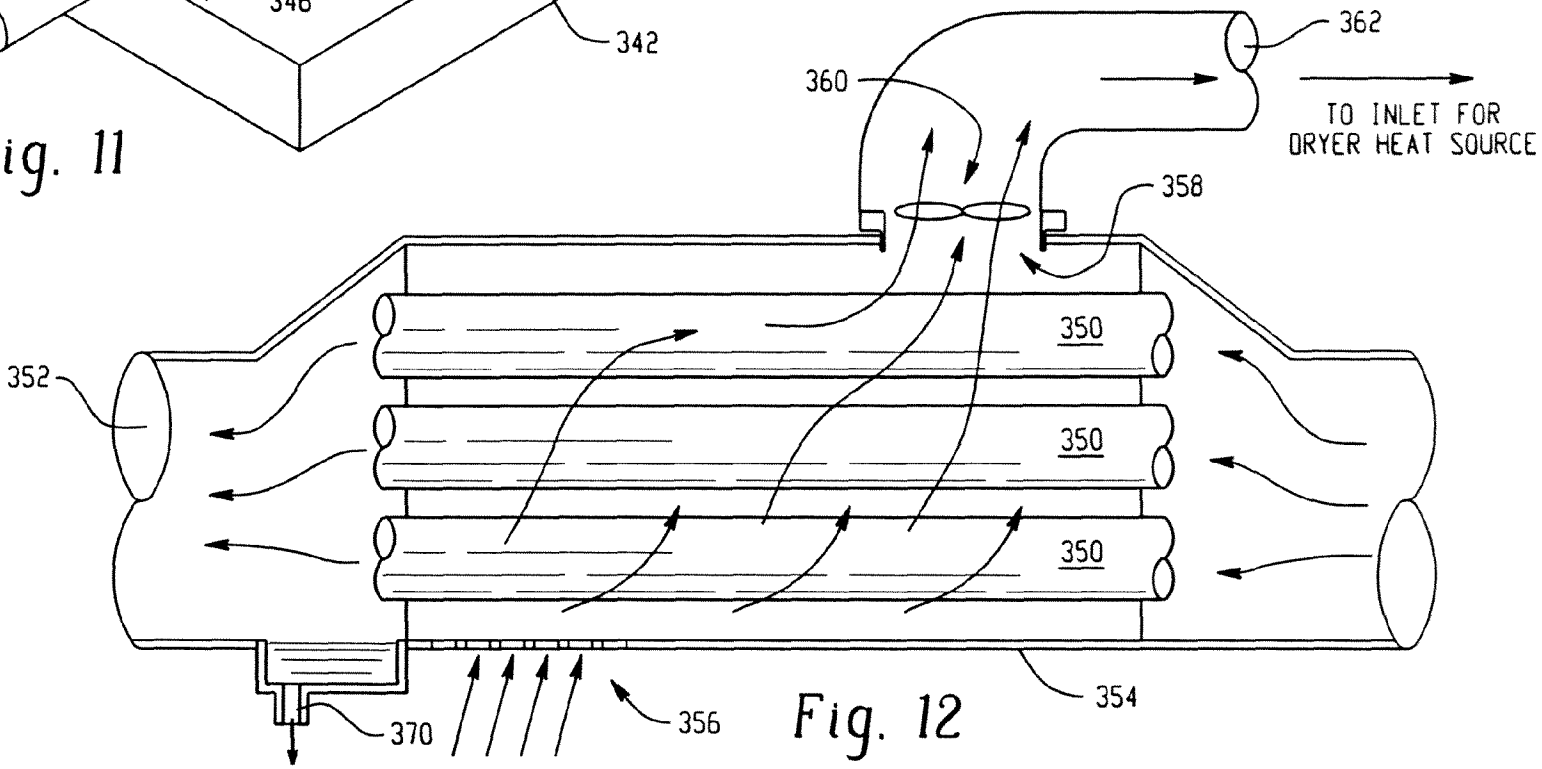
FIG. 12 is an enlarged cross-sectional view through a heat exchange component used in FIG. 11.

FIGS. 11 and 12 illustrate a multi-tube transition duct assembly 340 that may be used to efficiently transfer heat away from internal ducting, which can then be reintroduced into the inlet of the dryer. More particularly, the heat recovery assembly 340 may include a module or housing 342 that receives a multi-tube transition duct 344 associated with the blower 346 which receives exhaust air from the dryer. By this arrangement, air vented from the dryer reaches the blower 346 at blower inlet 348, and is then directed into dryer passages or tubes 350 that direct the elevated temperature air in the passages 350 toward outside vent 352. The individual passages 350 are received within a shell 354 having an inlet 356 that permits air from inside the dryer cabinet, for example at a temperature of approximately eighty (80°) F., to pass over external surfaces of the individual dryer passages 350 toward the outlet 358 and includes a blower 360 driven by a motor (not shown) to draw the air into the inlet 356 of the shell and across the dryer passages where the heat exchange results in an increase of air temperature of approximately twenty degrees (20°) F. to about one hundred degrees (100°) F., where the heat recovered air is then directed toward the heater intake 362 of the dryer. As will be appreciated, since the heat exchange takes place across the surface of the dryer tubes, residual condensate may collect at drain tube 370 and directed toward a drain, while the remaining exhaust air is directed toward the outside vent as represented at 352.

The disclosure has been described with reference to the preferred embodiments. Obviously, modifications and alterations will occur to others upon reading and understanding the preceding detailed description. For example, it will be appreciated that the particular temperature ranges, time periods, heater power levels, air flow rates, relative moisture contents, etc. may vary from those numerical values used in the described embodiments without departing from the scope and intent of the energy savings features. It is intended that the disclosure be construed as including all such modifications and alterations.

What is claimed is:

1. A method of drying wet clothes comprising:

dividing a clothes drying cycle into at least three drying periods including (i) a preheating stage, (ii) a latent heat transfer stage, and (iii) a sensible heat transfer stage; and varying air flow rate and power input to heater, both together or separately, in at least one of the stages relative to another stage, wherein the varying step including providing a low air flow at high air inlet temperature in the preheating stage, and providing a higher air flow in the sensible heat transfer stage.

2. The method of claim 1 further comprising providing a higher air flow at lower air inlet temperature in the latent heat transfer stage than the preheating stage.

3. The method of claim 2 further comprising providing the higher air flow at lower air inlet temperature in the sensible heat transfer stage.

4. The method of claim 1 further comprising providing a low air flow just prior to termination of the drying cycle.

5. The method of claim 1 further comprising providing a high temperature in the preheating stage.

6. The method of claim 5 further comprising providing a lower temperature in the latent heat transfer stage than the high temperature in the preheating stage.

7. The method of claim 6 further comprising continuing to provide a lower temperature in the sensible heat transfer stage than the high temperature in the preheating stage.

8. The method of claim 5 further comprising continuing to provide a lower temperature in the sensible heat transfer stage than the high temperature in the preheating stage.

9. The method of claim 1 further comprising providing a lower temperature in the sensible heat transfer stage than the high temperature in the preheating stage.

10. The method of claim 1 wherein air temperature entering an associated dryer or washer/dryer combination remains substantially constant throughout the drying cycle.

11. The method of claim 1 further comprising sensing at least one of an outlet temperature and dampness of the clothes during the drying cycle and altering at least one of the temperature and air residence time in response thereto.

12. The method of claim 1 wherein the varying step includes increasing a temperature of the clothes until sensible heat transfer is approximately equal to latent heat transfer, and subsequently terminating a hot air supply once moisture content in the clothes is reduced to a first level.

13. The method of claim 1 further comprising limiting heater power to approximately 2700 W.

14. The method of claim 1 further comprising introducing air from an external warm air source such as one of an attic or warm outside ambient air into an associated dryer or washer/dryer combination.

15. The method of claim 1 further comprising recovering heat from outlet air exiting an associated dryer or washer/dryer combination by directing recirculation air inside of an associated dryer housing across a passage containing the outlet air, and then directing the recirculation air to a heater intake of the associated dryer.

16. The method of claim 1 further comprising:

receiving air from a drum of a dryer and directing the air to an outside vent; and recirculating air from within a housing of the associated dryer about an exhaust passage, and directing the recirculated air toward a heater intake of the associated dryer.

17. The method of claim 16 further comprising varying amounts of air recirculated in the associated dryer.

18. The method of claim 17 further comprising varying an amount of air exhausted outside of the associated dryer housing.

19. The method of claim 16 further comprising varying an amount of air exhausted outside of the associated dryer housing.

20. A method of drying wet clothes comprising:

dividing a clothes drying cycle into at least three drying periods including (i) a preheating stage, (ii) a latent heat transfer stage, and (iii) a sensible heat transfer stage;

in the preheating stage, providing a low, first airflow at an elevated air inlet temperature, in the latent heat transfer stage, providing an increased, second airflow that is greater than the first airflow rate and at a lower air inlet temperature than the preheating stage, and in the sensible heat transfer stage increasing the airflow rate to a greatest, third airflow and at a lowest, air inlet temperature when compared to the preheating and sensible heat transfer stages.

21. The method of claim 20, further comprising one of (i) supplying heat at a first level for about one half of a dryer cycle time period, and reducing the heat level to approximately one-half of the original heat level during the remaining half portion of the dryer cycle time period, and (ii) periodically stepping down the amount of heat over the dryer cycle time period.

22. The method of claim 20 wherein the air inlet temperature is approximately 290 degrees F. at an air flow rate of approximately 90 CFM in the preheating stage, at approximately 260 degrees F. at an air flow rate of approximately 140 CFM in the latent heat transfer stage, and at approximately 220 degrees F. at 190 CFM in the sensible heat transfer stage.

23. The method of claim 20 further comprising monitoring at least one of dryer outlet temperature and clothes dampness and reducing at least one of air flow or inlet temperature in response thereto.

* * * * *